US007175211B2

(12) United States Patent
Cetnar et al.

(10) Patent No.: US 7,175,211 B2
(45) Date of Patent: Feb. 13, 2007

(54) LATCH WITH SHIPPING CONDITION

(75) Inventors: Roman Cetnar, Newmarket (CA); Kris Tomaszewski, Newmarket (CA); Jozef Pawlus, Mississauga (CA)

(73) Assignee: Intier Automotive Closures Inc., Newmarket (CA)

( * ) Notice: Subject to any disclaimer, the term of this patent is extended or adjusted under 35 U.S.C. 154(b) by 60 days.

(21) Appl. No.: 10/505,667

(22) PCT Filed: Feb. 25, 2003

(86) PCT No.: PCT/CA03/00251

§ 371 (c)(1),
(2), (4) Date: Apr. 11, 2005

(87) PCT Pub. No.: WO03/071058

PCT Pub. Date: Aug. 28, 2003

(65) Prior Publication Data

US 2005/0173933 A1 Aug. 11, 2005

(51) Int. Cl.
*E05C 3/06* (2006.01)
*E05B 3/00* (2006.01)

(52) U.S. Cl. ..... 292/216; 292/201; 292/DIG. 23; 292/DIG. 61; 292/DIG. 64

(58) Field of Classification Search ..... 292/201, 292/216, DIG. 23, DIG. 61, DIG. 64, DIG. 53
See application file for complete search history.

(56) References Cited

U.S. PATENT DOCUMENTS 2,793,898 A * 5/1957 Roethel ..... 292/280
4,202,571 A * 5/1980 Nishikoori ..... 292/216
4,643,470 A * 2/1987 Kazuyuki et al. ..... 292/216
4,929,007 A 5/1990 Bartczak et al.
5,071,179 A 12/1991 Brackmann
5,492,379 A 2/1996 Staser et al.
5,622,396 A 4/1997 Neumann
5,636,879 A 6/1997 Tanaka et al.
5,967,572 A 10/1999 Sajfert
6,254,148 B1 7/2001 Cetnar
6,805,386 B2 * 10/2004 Ehret et al. ..... 292/216

FOREIGN PATENT DOCUMENTS

FR 2 769 035 9/1997

* cited by examiner

*Primary Examiner*—Brian E. Glessner
*Assistant Examiner*—Carlos Lugo
(74) *Attorney, Agent, or Firm*—Clark Hill PLC

(57) ABSTRACT

A vehicle latch has a housing with a detent and a stop. A lever is pivotally connected to the housing and movable from an install position engaging the housing to an active position pivoted away from the housing. A spring extends from the lever to the housing applying a biasing force to the lever urging the lever to the install position. The spring has a tail portion, a coil section and an opposite end. The opposite end engages the lever. The tail end is moveable to engage either the stop or detent. In the install position, the tail end engages the detent and also engages the lever. In this position, the spring increases the biasing force holding the lever in the install position. The tail end is removable from the detent to engage the stop when the lever is first pivoted away from the install position. This disengages the tail end from the lever and also reduces the biasing force on the lever.

9 Claims, 3 Drawing Sheets

LATCH WITH SHIPPING CONDITION

FIELD OF THE INVENTION

This invention relates to a vehicle latch that can hold a lever, in particular a release lever, during shipping and installation.

BACKGROUND OF THE INVENTION

Vehicle latches generally comprise a housing, a ratchet, a pawl, an inside release lever, an outside release lever, an inside locking lever, and an outside locking lever. The various levers are operably coupled to the pawl to effect the various functions of the latch. Examples of typical latches are disclosed in U.S. Pat. Nos. 4,929,007 and 6,254,148.

Each of the various levers are operably connected, typically via a Bowden cable or rigid rod, to a respective handle or lever. A Bowden cable can be adjusted after the lever is installed. However, a rigid rod cannot be adjusted after the clip connecting the release lever to the rod has been closed. If the release lever is not in the correct position for installation, the attachment of the release lever to the clip will leave the release lever in a less than optimum position. If the release lever is unable to return to the designed rest or ready position, the release lever may block or prevent the locking lever from freely moving preventing the latch from fully locking or unlocking.

In current production latches for Volkswagen and Audi, the latch is provided with a spring that biases the release lever to the designed rest or ready position to ensure that the latch can be properly installed. Once the latch is installed and attached to the rigid rod to operably connect the release lever to the outside handle, the spring is disengaged from the release lever, allowing normal operation of the latch. The spring can be re-engaged for re-installation after service. However, in normal operation, the spring provides no useful function.

SUMMARY OF THE INVENTION

The disadvantages of the prior art may be overcome by providing a latch having a housing having a detent positioned to retain a spring coupled to a lever and thereby selectively position the lever in an "install" position during shipping and installation.

According to one aspect of the invention a vehicle latch is provided which includes a housing having a detent and a stop. A lever having an abutment is pivotally connected to the housing. A spring having a coil section, a tail portion and an opposite portion is mounted in the housing. The opposite portion biases the lever to a predetermined position. The tail portion is moveable from an install position to an operational position. In the install position the tail portion engages the detent and the lever abutment so as to locate the lever at the predetermined position. In the operational position the tail portion is biased to engage the stop when the lever is first pivoted away from the predetermined position.

In the preferred embodiment the predetermined position of the lever in the install position is a position in which the lever engages the housing. The predetermined position of the lever in the operational position is the same position of the lever as in the install position.

In the preferred embodiment the opposite end of the spring engages the lever and provides a greater force to bias the lever to the predetermined position when the tail portion is in the install position than when the tail portion is in the operational position. The tail portion of the spring is removable from the detent upon application of a force on the lever, said force being greater than the bias force on the lever provided by the spring.

According to another aspect of the invention, a vehicle latch is provided having a housing with a detent and a stop. A lever is pivotally connected to the housing and is movable from a ready position engaging the housing to an active position pivoted away from the housing. A spring extends from the lever to the housing applying a biasing force to the lever urging the lever to the ready position. The spring has a tail portion, a coil section and an opposite end. The opposite end engages the lever to provide the biasing force which moves the lever to the ready position. The tail end is moveable to engage either the stop or detent. When the tail end engages the detent, the tail end also engages the lever and the biasing force holding the lever in the ready position is increased. The tail end is removable from the detent to engage the stop when the lever is first pivoted away from the ready position, disengaging the lever from the tail end and thus reducing the biasing force on the lever.

BRIEF DESCRIPTION OF THE DRAWINGS

In drawing that illustrate embodiments of the present invention.

DETAILED DESCRIPTION OF THE INVENTION

Figure 1:
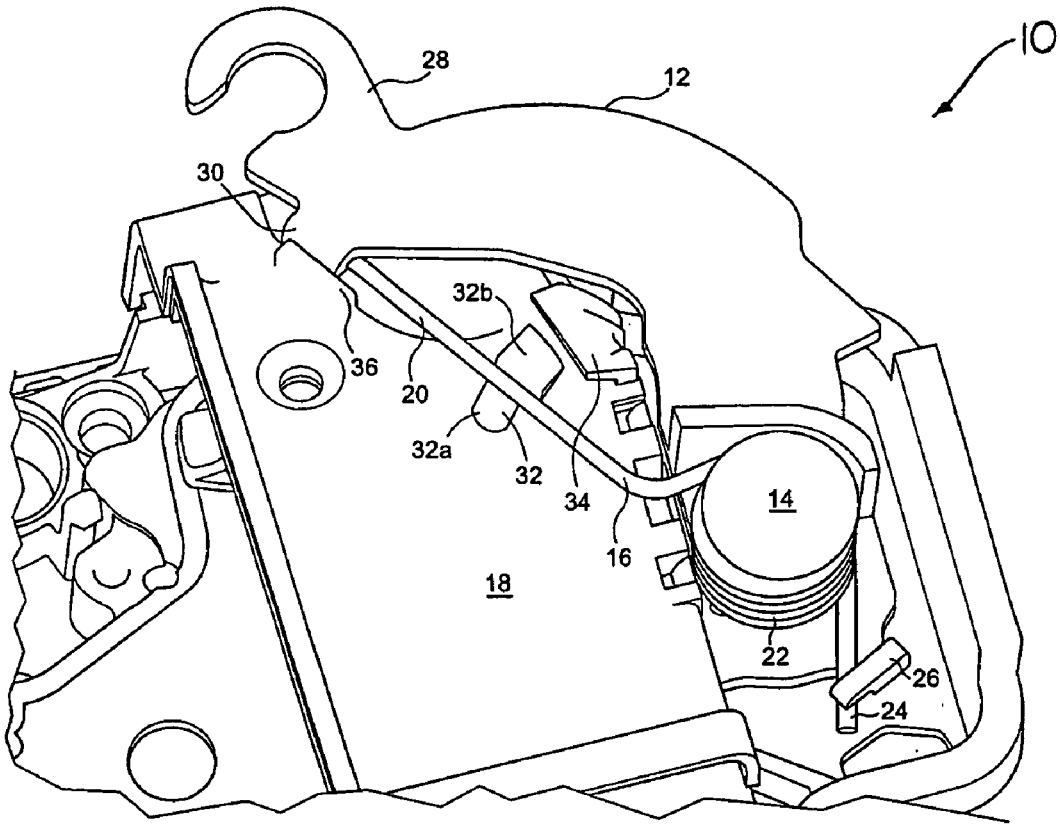
FIG. 1 is a perspective view of latch of the present invention with the lever in a "ready" position and the tail end of the spring in an "install" position.

FIG. 1 illustrates a latch 10 of the present invention. The latch 10 is of conventional construction and design. Typically, latch 10 can have four levers, an inside and outside locking lever and an inside and outside release lever. Although the invention could be applied to any of these levers, the invention is preferably applied to the outside release lever for an operative connection to an outside door handle.

The latch 10 has a lever 12 that is pivotally connected to the latch 10 at pin 14. A spring 16 extends between the lever 12 and the housing 18 of the latch 10. Spring 16 has an elongated tail portion 20 extending from a coil section 22 wound about the pin 14, terminating in an opposite end 24. End 24 engages a tab 26 of lever 12. The tail portion 20 of the spring 16 engages a connecting end 28 of the lever 12 at an abutment or tab 30.

Housing 18 has a detent 32, preferably formed from two wedge shaped parts 32*a*, 32*b* molded in the face of the housing, and a stop 34. The detent 32 is located such that the tail portion 20 extends from the coil section 22 to engage tab 30 while tab 30 engages a stop 36 formed in the housing. Detent 32 is sized to firmly hold the tail portion 20 in this position, namely, an "install" or shipping position. In this position, the lever 12 cannot be moved away from the stop 36 unless a significant force is applied sufficient to dislodge the tail portion 20 out of the detent 32. The spring 16 also provides a bias force to urge the lever 12 against stop 36. In this position, the connecting rod or Bowden cable can be attached to the connecting end 28 of the lever.

Figure 2:
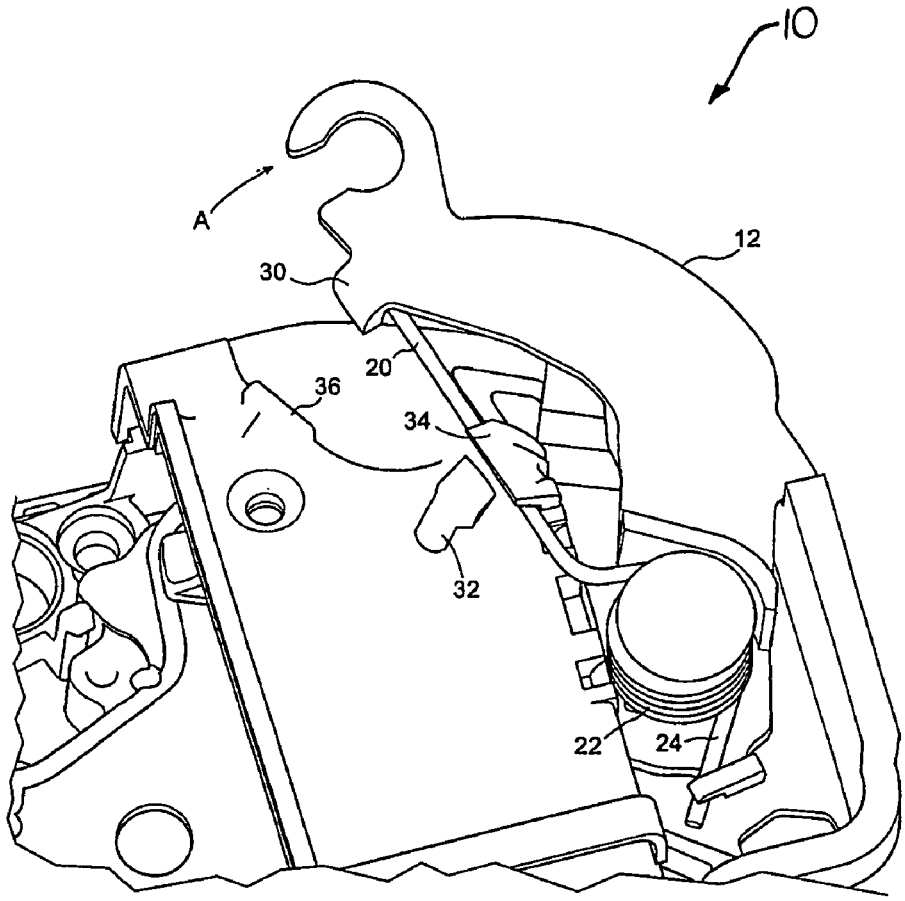
FIG. 2 is perspective view of the latch of FIG. 1 with the lever in a first pull or "active" condition.
Figure 3:
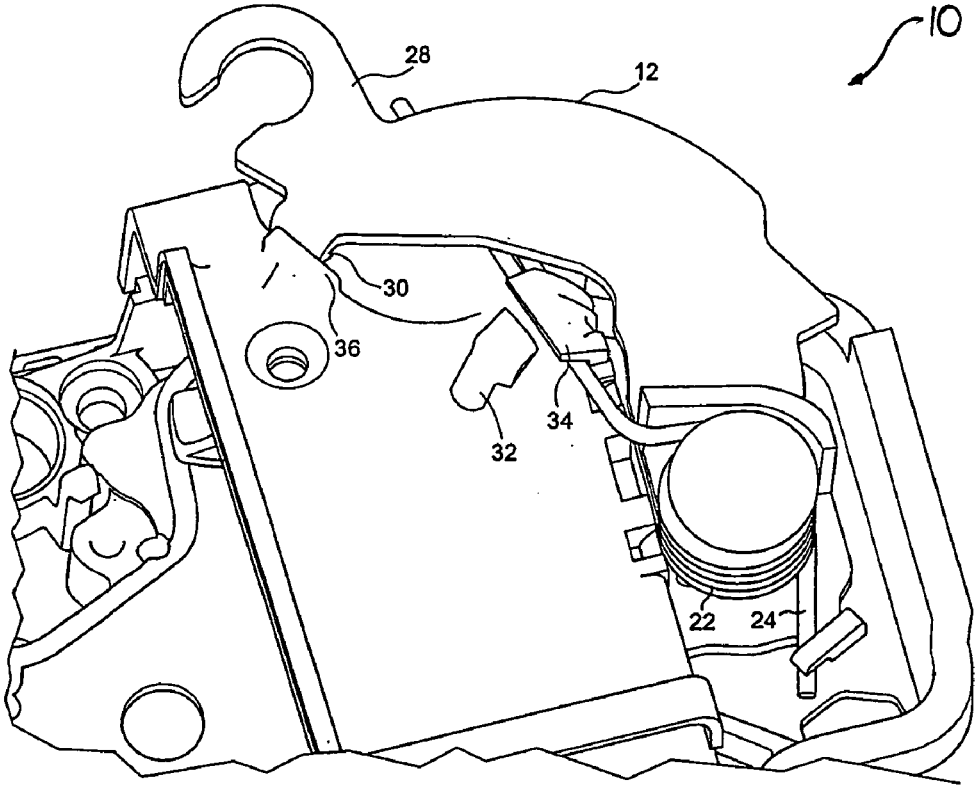
FIG. 3 is a perspective view of the latch of FIG. 1, with the lever in the ready position and the tail end of the spring in an "operational" condition.

Once the rod or Bowden cable is attached to the connecting end 28, the handle is operated, pulling the lever 12 in the direction of arrow A (FIG. 2) from a ready position to an active position. As tab 30 abuts the tail portion 20, the pulling force will urge the tail portion 20 over the detent 32 whereupon spring bias will snap the tail end 20 into an operational position, engaging the stop 34, as shown in FIG. 2. The spring, operating through opposite end 24, will urge the lever 12 back to abut stop 36, as shown in FIG. 3. However, since the tail end 20 now rests against stop 34, the force required to activate the lever 12 is equivalent to a biasing force provided by the opposite end 24 of spring 22, consistent with normal operation of the latch 10. In the install position, on the other hand, the spring 16 is contracted to a greater extent as shown in FIG. 1 thus providing a greater force acting on lever 12 so as to keep it in the install or shipping position.

The tail portion 20 can be returned to the shipping position by manually urging the tail portion 20 against the rotation of the coil section 22 and over the wedge of detent 32. The tail end 20 can be returned if the latch or the release handle is required to be serviced.

Although various preferred embodiments of the present invention have been described in detail, it will be appreciated by those skilled in the art that variations may be made without departing from the spirit of the invention.

The invention claimed is:

1. A vehicle latch, comprising:

a) a housing having a detent and a stop;

b) a lever pivotally connected to the housing, the lever having an abutment; and c) a spring having a coil section, a tail portion and an opposite portion for biasing the lever to a predetermined position, the tail portion being moveable from an install position to an operational position, wherein in the install position the tail portion engages the detent and the lever abutment so as to locate the lever at the predetermined position, and in the operational position the tail portion is biased to engage the stop when the lever is first pivoted away from the predetermined position.

2. A latch according to claim 1, wherein the predetermined position of the lever is the install position is a position in which the lever engages the housing.

3. A latch according to claim 2, wherein the predetermined position of the lever in the operational position is the same position of the lever in the install position.

4. A latch according to claim 1, wherein the opposite end engages the lever and provides a greater force to bias the lever to the predetermined position when the tail portion is in the install position than when the tail portion is in the operational position.

5. A latch according to claim 1, wherein the tail portion of the spring is removable from the detent upon application of a force on the lever, said force being greater than the bias force on the lever provided by the spring.

6. A latch according to claim 1, wherein the lever is operatively connected to an outside door handle.

7. A latch according to claim 1, wherein the tail portion of the spring is moveable from the operational position to the install position.

8. A latch according to claim 1, wherein the coil section of the spring is mounted to a pivot pin about which the lever rotates.

9. A vehicle latch having:

a) a housing having a detent and a stop, b) a lever pivotally connected to said housing and moveable from a ready position engaging said housing and an active position pivoted away from said housing, c) a spring extending from said lever to said housing applying a biasing force to said lever urging said lever to the ready position, said spring having a tail portion, a coil section and an opposite end, said opposite end engaging said lever, said tail portion moveable to engage either of said stop and said detent, when said tail portion engages said detent, said tail portion engages said lever and said spring increases said biasing force housing said lever in said ready position, said tail portion removable from said detent to engage said stop when said lever is first pivoted away from the ready position disengaging from said tail portion and thereby reducing said biasing force on said lever.

* * * * *